US011807408B2

(12) United States Patent
Orr

(10) Patent No.: US 11,807,408 B2
(45) Date of Patent: Nov. 7, 2023

(54) DEVICE FOR RELEASABLY SECURING A FLEXIBLE LINER ABOUT THE RIM OF A SUPPORTING RECEPTACLE AND A METHOD THEREFORE

(71) Applicant: Kirk Orr, Spokane, WA (US)

(72) Inventor: Kirk Orr, Spokane, WA (US)

( * ) Notice: Subject to any disclaimer, the term of this patent is extended or adjusted under 35 U.S.C. 154(b) by 0 days.

(21) Appl. No.: 17/128,682

(22) Filed: Dec. 21, 2020

(65) Prior Publication Data

US 2021/0221549 A1 Jul. 22, 2021

Related U.S. Application Data

(60) Provisional application No. 62/995,257, filed on Jan. 21, 2020.

(51) Int. Cl.
*B65B 67/12* (2006.01)
*B65F 1/06* (2006.01)

(52) U.S. Cl.
CPC ..... *B65B 67/1233* (2013.01); *B65F 1/06* (2013.01)

(58) Field of Classification Search
CPC . B65B 67/12; B65B 67/1222; B65B 67/1227; B65B 67/1233; B65B 2067/1283; B65D 33/1641; B65F 1/06; B65F 1/141; B65F 1/1415; Y10T 24/15; Y10T 24/157
USPC ..... 24/30.5 R, 30.5 T, 71.1; 242/388.1, 242/388.2, 388.4
See application file for complete search history.

(56) References Cited

U.S. PATENT DOCUMENTS 1,261,505 A * 4/1918 Fitz ..... A44C 5/24 211/119.15
1,469,112 A * 9/1923 Schoonover ..... D06F 53/00 242/395
1,574,857 A * 3/1926 Barneck ..... D06F 53/04 24/910
3,228,076 A * 1/1966 Casey ..... B65B 67/06 24/30.5 R
3,874,638 A 4/1975 Langlie et al.
4,919,374 A * 4/1990 Julian ..... B65F 1/06 242/395
5,803,390 A * 9/1998 Clary ..... F16G 11/12 242/388.2
6,012,686 A * 1/2000 Julian ..... B65F 1/06 220/495.08
6,536,083 B1 * 3/2003 Dozzini ..... B65D 5/066 24/30.5 R (Continued)

FOREIGN PATENT DOCUMENTS

DE 202021001705 U1 * 8/2021 ..... B65B 67/1233

*Primary Examiner* — Jonathan Liu
*Assistant Examiner* — Guang H Guan
(74) *Attorney, Agent, or Firm* — Randall Danskin P.S.

(57) ABSTRACT

A fastener for releasably securing a flexible liner about a peripheral rim of a supporting receptacle has a generally planar body with a first leg and an interconnected second leg defining an inwardly tapered elongated space therebetween. An offset and elongated rotation handle carried at one end portion of the body opposite the first and second legs facilitates rotating the body axially about an axis of rotation to wind a portion of an edge portion of the flexible liner about the first and second legs, and a portion of the rotation handle releasably engages with the tensioned flexible liner to prevent the unwinding of the flexible liner.

11 Claims, 7 Drawing Sheets

(56) References Cited

U.S. PATENT DOCUMENTS

| | | | | |
|---|---|---|---|---|
| 6,918,505 | B2 * | 7/2005 | Gifford, Sr. | B65F 1/06 220/495.1 |
| 8,176,601 | B2 | 5/2012 | Orr | |
| 8,616,222 | B2 * | 12/2013 | Baker | A45D 19/00 132/270 |
| 2021/0221549 | A1 * | 7/2021 | Orr | B65F 1/06 |

* cited by examiner

DEVICE FOR RELEASABLY SECURING A FLEXIBLE LINER ABOUT THE RIM OF A SUPPORTING RECEPTACLE AND A METHOD THEREFORE

RELATED APPLICATIONS AND PRIORITY CLAIM

This Application claims the benefit of earlier filed U.S. Provisional Patent Application No. 62/995,257 filed on 21 Jan. 2020 and titled in FASTENER FOR RELEASABLY SECURING A FLEXIBLE LINER ABOUT THE RIM OF A SUPPORTING RECEPTACLE. The inventorship of previously filed U.S. Provisional Patent Application No. 62/995,257, and this US Utility Patent Application, is the same. Pursuant to USPTO Rules, this claim of priority is also being set forth in the Application Data Sheet (ADS) filed contemporaneously with this US Utility Patent Application.

FIELD OF INVENTION

This invention relates to fasteners, and more particularly to a device for releasably securing a flexible liner about the outer circumference of a supporting receptacle and a method for using such a fastener.

BACKGROUND AND DESCRIPTION OF PRIOR ART

It is a common practice in commercial and household locations to use one size of a waste receptacle in one location, and to use a different size waste receptacle in another location, for instance in a first case in a kitchen, and in a second case a bathroom or an office. Flexible bags which may be formed of, without limitation, plastic, latex, starch, plant materials, etc. are commonly used as replaceable liners inside such waste receptacles for easy and sanitary disposal of waste and trash deposited therein, such as, but not limited to, household waste, kitchen waste, office waste and even yard waste bags for collecting leaves and lawn clippings and the like, etc.

Because liners of waste receptacles are replaced so frequently, they are commonly purchased in large quantities and the same size liner is used in a variety of waste receptacles regardless of the receptacle size.

It is not common for such liners to fit firmly and tightly in an installed position. Most of the time, the liner is relatively large compared to the receptacle and therefore some portion of the liner fits loosely within the receptacle and an upper end opening portion of the liner extends loosely outwardly and downwardly relative to a peripheral rim of the receptacle.

When the liner has sufficient depth from top to bottom, a closed bottom portion of the liner rests directly upon the interior bottom of the receptacle. The result is that material deposited within the liner rests upon the interior bottom of the receptacle and liner will generally remain in position about the upper peripheral rim because the upper edge portions of the liner are not pulled downwardly into the receptacle.

However, when the liner and the receptacle have approximately the same depth/vertical dimension, or when the liner is not as deep as the receptacle, or when extreme loads are placed in the liner, the upper edge portions of the liner are pulled downwardly into the receptacle, when material is deposited therein. This may not be a significant issue for office type waste such as paper and envelopes, but can be a material issue if the liner is being used in a kitchen waste receptacle where food waste, and the like, is deposited because fluids, and semi-fluids and the like may leak outside of the liner into the waste receptacle causing nuisances that may be indelicate, and unsanitary as well as odoriferous.

Flexible liners may also be employed as disposable funnels. In such an instance, the closed bottom portion of a flexible bag-type liner maybe cutaway, or otherwise separated from, the flexible bag, and the lower downwardly disposed edges may be draped, or otherwise placed within, a second container that may have a diametrically reduced/smaller peripheral opening. The material to be transferred, such as, but not limited to a flowable liquid, a flowable solid, a particulate and the like, such as flour, sugar, paint, oils, liquid or semi-liquid materials, may be passed into an upper opening of the flexible liner that is secured about a peripheral rim of a supporting structure/receptacle. The material will pass along and through the flexible liner/funnel and into the second receptacle. Such a disposable funnel is easy and quick to manufacture, and utilize with my present invention. Similarly, the instant invention may be used to line the interior and exterior of a tube (rectilinear, cylindrical or otherwise) which may be open at one or both end portions. It is to be expressly understood, that the term "liner", as used herein, encompasses impermeable materials, such as, but not limited to plastic, latex and the like, as well as permeable materials such as, but not limited to mesh, screen and netting.

Various apparatus are known for securing an upper edge portion of a flexible liner around the rim of a waste receptacle. Known apparatus include stretchable elastic bands that extend about an outer circumference of the receptacle so as to positionally maintain the liner in a predetermined position, tying a knot in an excess portion of the liner gathered about the receptacle, a serrated edge hole or serrated edge slot defined in a side portion of the receptacle through which twisted excess liner is pulled, spring-biased clamps spaced about the receptacle rim, an annulus shaped apparatus through which a portion of the excess liner is pulled, and even an annulus shaped collar that extends circumferentially about and engages with the receptacle rim.

Such known apparatus have proved to be ineffective and/or too expensive for widespread use and continue to suffer from drawbacks including the requirement that the apparatus be attached to a trash receptacle before use, the apparatus is difficult or complicated to operate, the apparatus is expensive to manufacture, the apparatus is integral with the trash receptacle, the apparatus prevents re-use of the liner, the apparatus prevents the receptacle top from fitting correctly, the apparatus is difficult to remove, the apparatus is limited to use with a specific receptacle, the apparatus is not aesthetically appealing, the apparatus has sharp pointed edges that may injure a person/child/pet, as well as other drawbacks and limitations.

My invention overcomes various of the aforementioned drawbacks by providing a fastener for releasably securing a flexible liner about the rim of a supporting receptacle that is easy to use, cost effective to manufacture, is not integral with the receptacle, may be used with a plurality of trash receptacles and liners, does not interfere with the receptacle top, allows re-use of the receptacle, remains in place in extreme load conditions, is easy to remove and is sanitary and easy to clean.

My invention uses the resiliency of the flexible liner to supply a torquing force that causes one end portion of a rotation handle to frictionally contact a surface of the receptacle while the fastener is positionally retained by the flexible liner. Engagement of the rotation handle with the receptacle prevents the fastener from rotating axially which would allow the liner to unwind from the fastener.

My invention does not reside in any one of the identified features individually but rather in the synergistic combination of all of its structures, which give rise to the functions necessarily flowing therefrom as hereinafter specified and claimed.

SUMMARY

A principal aspect of the present invention is a fastener for releasably securing an opening edge portion of a flexible liner about a peripheral rim of a supporting receptacle comprising a body having a generally planar first side and a generally planar opposing second side, a first leg, a second leg, and a rotation handle that extends generally perpendicularly to the first leg and the second leg, and the body defines a rotation axis that is parallel to the first leg and to the second leg; the first leg and the second leg each have a first end portion that is proximate to the rotation handle and a second end portion that is distal from the rotation handle, and each of the first leg and the second leg have a length dimension; the first leg and the second leg each have a laterally outer edge and each have a laterally inner edge, and the laterally inner edge of the first leg is spaced apart from the laterally inner edge of the second leg by an elongated space, and an opening to the elongated space is defined between the second end portions of the first leg and the second leg; and the elongated space has a length dimension between the opening and a terminal end of the elongated space that is proximate to the rotation handle; and the rotation handle is elongate, is perpendicular to, and is offset relative to the rotation axis, and has a first handle and an opposing second handle and each of the first handle and the second handle have a length dimension and the length dimensions of the first handle and the second handle are not equal to one another.

A further aspect of the present invention is a fastener wherein a combined length dimension of the first handle and the second handle of the rotation handle is greater than the combined width dimension of the first leg, plus width dimension of the second leg plus width of the elongated space defined between the first leg and the second leg.

A further aspect of the present invention is a fastener wherein the rotation axis is axially aligned with the elongated space defined between the first leg and the second leg.

A further aspect of the present invention is a fastener further comprising a lever arm extension between the first end of the first leg and the first end of the second leg and the rotation handle.

A further aspect of the present invention is a fastener wherein the lever arm extension structurally communicates between the first end portions of the first and second legs and the rotation handle, and the lever arm extension has a length dimension between the terminal end of the elongated space and the rotation handle to space the first and second legs away from the rotation handle.

A further aspect of the present invention is a fastener wherein the second end portion of the first leg, and the second end portion of the second leg each have an inwardly curved corner that communicates with the respective laterally inner edge of the respective leg, and each leg has an angular corner that communicates with the respective laterally outer edge of the respective leg, and the inwardly curved corners of the second end portions of the first and second legs define the opening to the elongated space.

A further aspect of the present invention is a fastener wherein the elongated space has a first width dimension proximate to the opening of the elongated space and a second width dimension proximate to the terminal end of the elongated space, and the first and second width dimensions are not equal.

A further aspect of the present invention is a fastener wherein the first handle of the rotation handle has a linear top edge and a spaced apart bottom edge with a height dimension therebetween; and the second handle of the rotation handle has a linear top edge and a spaced apart linear bottom edge with a height dimension therebetween, and each of the first handle and the second handle have a terminal end opposite the opposing handle, and each terminal end is rounded.

A further aspect of the present invention is a fastener wherein the length dimension of the second handle is greater than the length dimension of the first handle.

A still further aspect of the present invention is a fastener wherein the combined length dimensions of the first handle plus the length dimension of the second handle is greater than the combined length dimensions of the first leg, plus the length dimension of the lever arm extension, plus the height dimension of the rotation handle.

A still further aspect of the present invention is a fastener wherein the rotation handle is offset relative to the rotation axis.

A still further aspect of the present invention is a fastener wherein the first handle and the second handle provide a lever arm that facilitates axial rotation of the body about the axis of rotation.

An even still further aspect of the present invention is a fastener wherein the second handle engages with, and is positionally maintained between the flexible liner and the receptacle so as to secure the fastener and the flexible liner in a secured position relative to the receptacle.

An even still further aspect of the present invention is a fastener for releasably securing an opening edge portion of a flexible bag-type liner about a rim of a supporting receptacle comprising a body having a generally planar first side and a generally planar opposing second side, a first leg, a second leg, a lever arm extension, and a rotation handle that extends generally perpendicularly to the lever arm extension and perpendicular to the first leg and the second leg, and the body defines a rotation axis that is parallel to the first leg and to the second leg, the first leg and the second leg each have a first end portion that is interconnected with the lever arm extension and proximate to the rotation handle and each of the first leg and the second leg have a second end portion that is distal from the lever arm extension and distal from rotation handle, and each of the first leg and the second leg have a length dimension, and the first leg and the second leg each have a laterally outer edge and each have an opposing and spaced apart laterally inner edge, and the laterally inner edge of the first leg is spaced apart from the laterally inner edge of the second leg by an elongated space that is defined between the first leg and the second leg, the second end portion of the first leg, and the second end portion of the second leg each have an inwardly curved corner that communicates with the respective laterally inner edge and each have an angular corner that communicates with the respective laterally outer edge, and the inwardly curved corners of the second end portions of the first and second legs define an opening to the elongated space, and the elongated space has a length dimension between the opening and a terminal end of the elongated space that is proximate the lever arm extension, and the elongated space has a first width dimension proximate to the opening and a second width dimension proximate to the terminal end of the elongated space which is different than the first width dimension, and the lever arm extension structurally communicates between the first end portions of the first and second legs and the rotation handle, and the lever arm extension has a length dimension between the terminal end of the elongated space and the rotation handle to space the first and second legs away from the rotation handle, and the rotation handle is elongate, is perpendicular to, and is offset relative to the rotation axis, and has a first handle having a linear top edge and a spaced apart bottom edge with a height dimension therebetween, and has an opposing second handle that has a linear top edge and a spaced apart linear bottom edge with a height dimension therebetween, and each of the first handle and the second handle have a length dimension and the length dimensions of the first handle and the second handle are not equal to one another, and the rotation handle structurally communicates with the lever arm extension opposite the first and second legs, and each of the first handle and the second handle have a terminal end opposite the opposing handle, and each terminal end is rounded.

An even still further aspect of the present invention is a method for using fastener for releasably securing an opening edge portion of a flexible liner about a rim of a supporting receptacle comprising the steps: providing a fastener having a body with a generally planar first side and a generally planar opposing second side, a first leg, a second leg, and a rotation handle that extends generally perpendicularly to the first leg and the second leg, and the body defines a rotation axis that is parallel to the first leg and to the second leg, and wherein the first leg and the second leg each have a laterally outer edge and each have a laterally inner edge, and the laterally inner edge of the first leg is spaced apart from the laterally inner edge of the second leg by an elongated space that is defined between the first leg and the second leg, and an opening to the elongated space is defined between the first leg and the second leg opposite the rotation handle, and wherein the elongated space has a length dimension between the opening and a terminal end of the elongated space proximate to the rotation handle, and wherein the rotation handle is elongate and is offset relative to the rotation axis, and has a first handle and an opposing second handle and each of the first handle and the second handle have a length dimension and the length dimensions of the first handle and the second handle are not equal to one another; passing an edge portion of flexible liner into and through opening between the first and second legs and into the elongated space defined between the first leg and the second leg so that the edge portion of the flexible liner is in direct physical contact with the terminal end of the elongated space; rotating the body axially about the rotation axis by means of the rotation handle by twisting the body in a clockwise direction, or a counterclockwise direction, to cause a portion of the edge portion of the liner to wind around/gather around and about the first leg and second leg, and the lever arm extension so that the liner becomes tensioned/stretched about a periphery of the receptacle; positionally retaining the body that is engaged with the tensioned/stretched liner to prevent the body from unwinding; drawing an edge portion of the tensioned/stretched liner that is proximate the rotation handle outwardly from supporting receptacle; tucking a portion of the rotation handle under the drawn out portion of the tensioned/stretched liner so that the tucked under portion of the rotation handle is between the tensioned/stretched liner edge portion and the supporting receptacle; and releasing the edge portion of the tensioned/stretched liner to positionally secure the tucked under portion of the body between the liner and the supporting receptacle.

Other and further aspects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified, as is required.

BRIEF DESCRIPTIONS OF DRAWINGS

In the accompanying drawings which form a part hereof and wherein like numbers refer to similar parts throughout:

Figure 10:
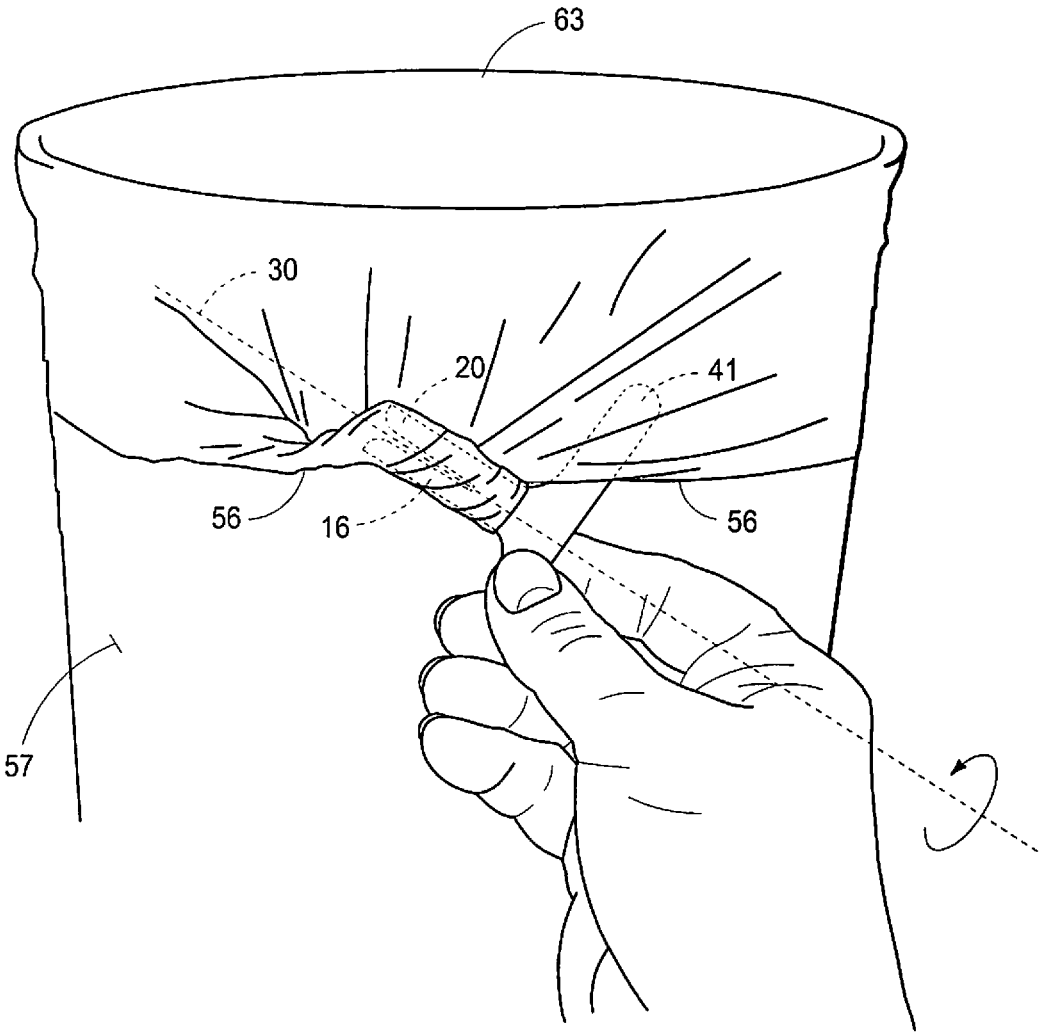

FIG. 10 is an orthographic inverted second side environmental view of my fastener in a third step showing my fastener engaged with an opening edge portion of a flexible liner extending about an upper outer peripheral rim of a supporting receptacle, after tightening/rotation/twisting, and showing the longer leg engaged under the flexible liner so as to be retained in position to secure the flexible liner about the receptacle.

Figure 11:
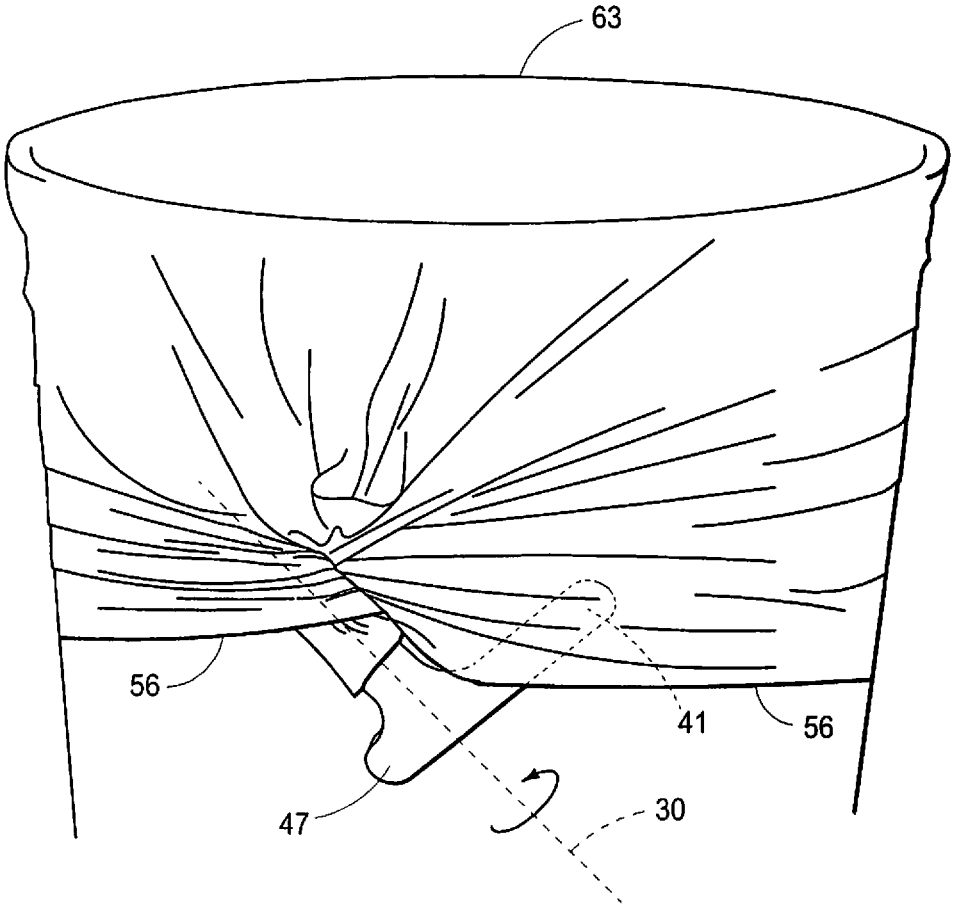

FIG. 11 is an orthographic inverted second side environmental view, similar to FIG. 10, showing my fastener in an installed and use position relative to the flexible liner and relative to the supporting receptacle.

DETAILED WRITTEN DESCRIPTION OF THE PREFERRED EMBODIMENTS

This disclosure of the invention is submitted in furtherance of the Constitutional purposes of the U.S. Patent Laws "to promote the progress of science and useful arts" (Article 1, Section 8).

Figure 1:
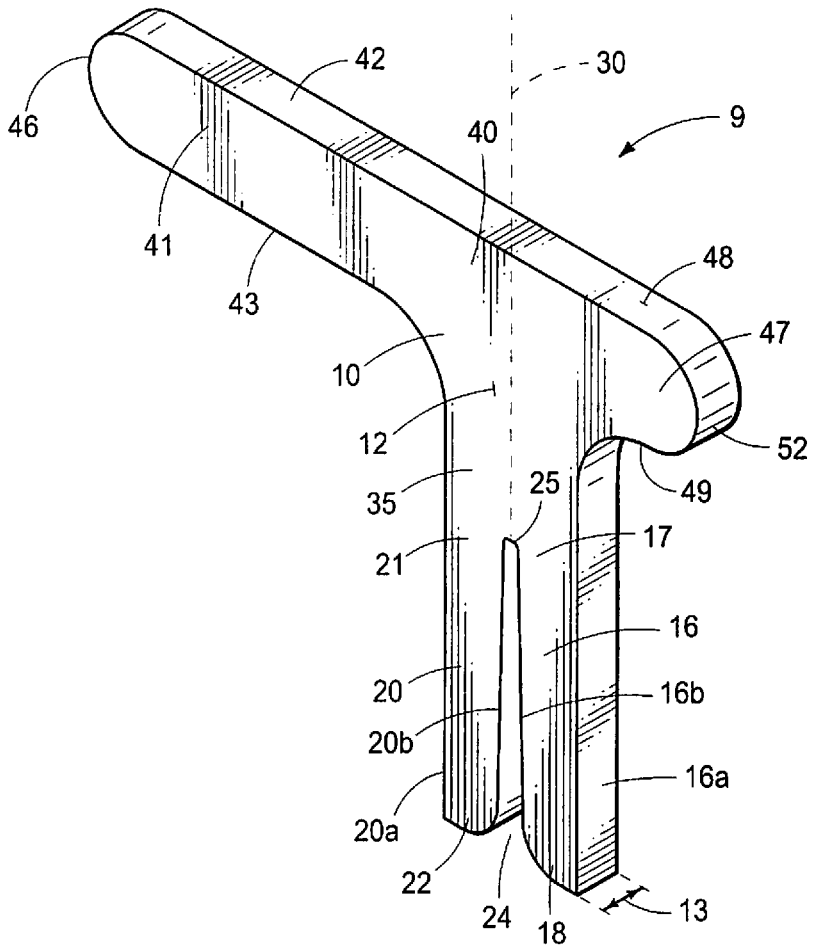
FIG. 1 is a perspective second side, top and right side view of my fastener for releasably securing a flexible liner about the rim of a supporting receptacle.

The fastener of the present invention is generally indicated by the numeral 9 in FIG. 1 and following.

A fastener 9 for releasably securing an opening edge portion 56 of a flexible liner 55 about a peripheral rim 63 of a supporting receptacle 57 provides a body 10 having a generally planar first side 11 and a generally planar opposing second side 12, a first leg 16, a second leg 20, a lever arm extension 35, and a rotation handle 40.

Figure 2:
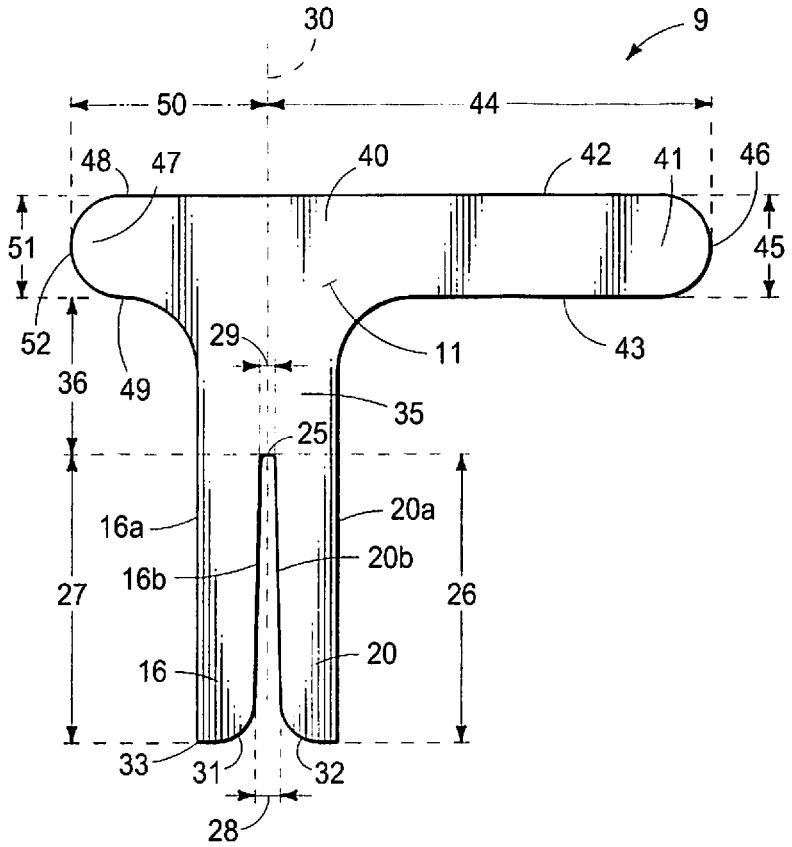
FIG. 2 is an orthographic first side view thereof.
Figure 3:
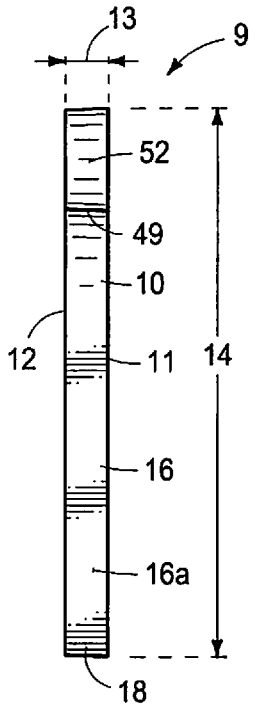
FIG. 3 is an orthographic right side view thereof.
Figure 4:
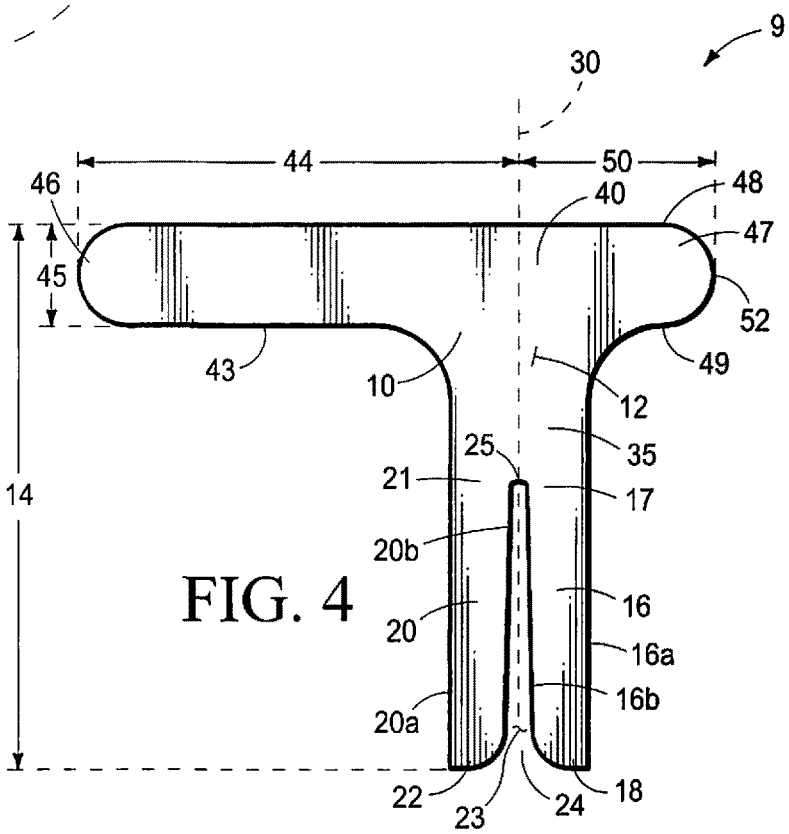
FIG. 4 is an orthographic second side view thereof.
Figure 7:
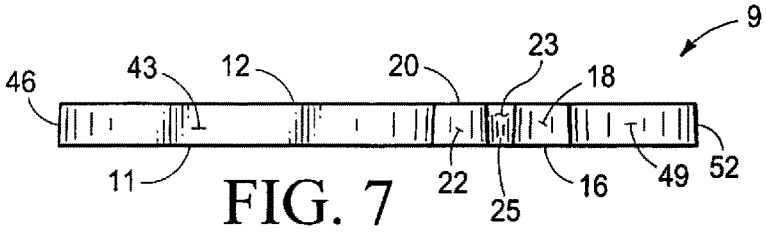
FIG. 7 is an orthographic bottom view thereof.

As shown in FIGS. 1, 2 and 4, the body 10 is somewhat "T" shaped. The first leg 16 and the second leg 20 each extend somewhat vertically downwardly, and each have a first end portion 17, 21 that is interconnected with the lever arm extension 35, and each of the first leg 16 and the second leg 20 have a second end portion 18, 22 that is distal from the lever arm extension 35. Further, each of the first leg 16 and the second leg 18 have a length dimension 27. (FIG. 2).

The first leg 16 and the second leg 20 each have a laterally outer edge 16*a*, 20*a* and each have a spaced apart laterally inner edge 16*b*, 20*b*, and the laterally inner edge 16*b* of the first leg 16 is spaced apart from the laterally inner edge 20*b* of the second leg 20 by an elongated space 23 that is defined therebetween.

The second end portion 18 of the first leg 16, and the second end portion 22 of the second leg 20 each define an inwardly curved corner 31, 32 (FIG. 2) that communicates with the respective laterally inner edge 16*b*, 20*b* and each define an angular corner 33, 34 that communicates with the respective laterally outer edge 16*a*, 20*a*. The inwardly curved corners 31, 32 of the second end portions 18, 22 of the first and second legs 16, 20 respectively define an opening 24 to the elongated space 23.

Best shown in FIG. 2, the elongated space 23 has a length dimension 26 between the opening 24 and a terminal end 25 of the elongated space 23 proximate the lever arm extension 35. Further, the elongated space 23 has a first width dimension 28 proximate to the opening 24, and a smaller second width dimension 29 proximate to the terminal end 25. The first width dimension 28 is larger than the second width dimension 29 so that the elongated space 23 is tapered inwardly toward the terminal end portion 25. The inwardly tapering enhances "gripping" and surface friction so that the fastener 9 more securely engages with the edge portion 56 of the liner 55.

As shown in FIGS. 1, 2 and 4, a rotation axis 30 is defined between the first leg 16 and the second leg 20, and the rotation axis 30 extends along and parallel to the medial space 23. In use, the body 10 is axially twisted about the rotation axis 30.

The lever arm extension 35 structurally communicates between the first end portions 17, 21 of the first and second legs 16, 20 respectively, and the rotation handle 40. The lever arm extension 35 has a length dimension 36 (FIG. 2) between the terminal end 25 of the elongated space 23 and the rotation handle 40 so as to space the first and second legs 16, 20 away from the rotation handle 40 to facilitate winding a portion of the flexible liner 55 about the fastener 9, as shown in FIG. 10. Because some flexible bag-type liners 55 have an incorporated drawstring type closure (not shown) within the edge portion 56, the edge portion 56 typically has a greater thickness dimension (not shown) that is accommodated by the lever arm extension 35. Further, the increased thickness dimension (not shown) is better gripped by the inwardly tapering of the elongated space 23, and the terminal and 25 thereof.

The rotation handle 40 is interconnected with (or integral with) the lever arm extension 35 opposite the legs 16, 20. The rotation handle 40 is elongate and is generally perpendicular to, and offset, relative to the rotation axis 30. The rotation handle 40 has a first handle 47 proximate to the first leg 16 that has a linear top edge 48 and a bottom edge 49 with a height dimension 51 therebetween. The rotation handle 40 further has a second handle 41 proximate to the second leg 20 that has a linear top edge 42 and a linear bottom edge 43 with a height dimension 45 therebetween. Each of the first handle 47 and the second handle 41 has a length dimension 50, 44 respectively and the length dimensions 50, 44 are not equal to one another so that the rotation handle 40 may provide leverage for rotation of the body 10 about the axis of rotation 30, and the stretching of the flexible liner 55.

The length dimension 44 of the second handle 41, which is greater than the length dimension 50 of the first handle 47, further facilitates securing the fastener 9 to the supporting trash receptacle 57 by utilizing the elasticity and resiliency of the flexible liner 55.

As shown in FIGS. 10 and 11, after the rotation handle 40 has been utilized to apply a torqueing force to "wind"/"wrap" an amount of the edge portion 56 of the flexible liner 55 about the two legs 16, 20 and the lever arm extension 35, the second handle 41 is "tucked" under the now "tightened"/"stretched" edge portion 56 of the flexible liner 55. The tension of the "tightened"/"stretched" edge portion 56 positionally secures a portion of the rotation handle 40 between (under) the flexible liner 55 and frictionally against an exterior surface of the supporting receptacle 57. The elasticity and tension of the "tightened"/"stretched" liner 55 prevents the fastener 9 from "un-twisting". Each of the first handle 47 and the second handle 41 have a terminal end 52, 46 respectively opposite the opposing handle 41, 47, and each terminal end 52, 46 is rounded so as to not unintentionally tear or pierce the flexible liner 55.

Figure 6:
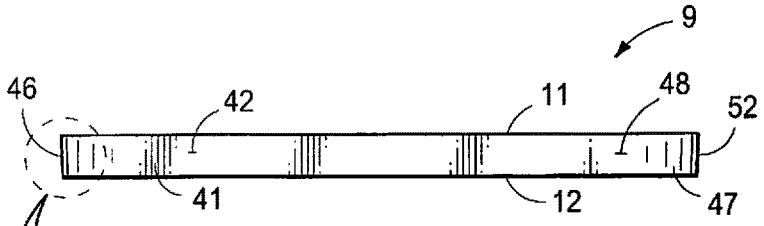
FIG. 6 is an orthographic top view thereof.
Figure 6A:
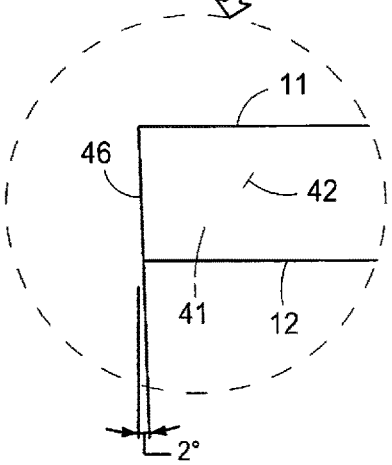
FIG. 6A is an enlarged partial cutaway view of FIG. 6 showing the details of the edge portion.
Figure 5:
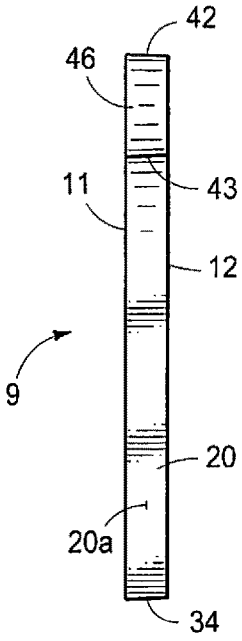
FIG. 5 is an orthographic left side view thereof.

As shown in enlarged FIG. 6A, the terminal ends 46, 52 need not be 90° corners, relative to the first and second planar sides 11, 12 respectively, but rather the terminal ends 46, 52 may be angulated/beveled to enhance gripping of the fastener 9 to the flexible liner 55.

Thickness 13 of the body 10 between the first planar side 11 and the second planar side 12 is between approximately 2.5 millimeters and 10 millimeters and is optimally approximately 5 millimeters so that my fastener 9 may be used to secure a flexible liner 55 about upper peripheral rim 63 of an inner member (not shown) of a sleeve-type trash receptacle 57. The minimal thickness 13 of the body 10 allows my fastener 9 to be placed in adjacency to the upper peripheral rim 63 of inner member and allows the inner member slide axially into the chamber (not shown) defined by outer member (not shown) of the sleeve type trash receptacle 57 without interfering with the operation of any movable receptacle top or the co-axial engagement of the two sleeve-type receptacles.

My fastener 9 is preferably formed of poly-carbonate which provides a durable, rigid and cost effective material that may be molded, extruded or stamped for ease of manufacture, is easy to clean and is not subject to bacterial contamination and the like. Other materials having similar desirable characteristics include but are not limited to metallic alloys, ceramics, plastic, nylon, fiberglass, carbon fiber, polypropylene and the like. Further, my fastener 9 may be formed as a unitary single piece body 10, or my fastener 9 may be manufactured in plural pieces which are thereafter joined together to form the body 10.

My invention is further a method for using my fastener 9 for releasably securing an opening edge portion 56 of a flexible liner 55 about a rim 63 of a supporting receptacle 57 comprising the steps:

Providing a fastener 9 having a body 10 with a generally planar first side 11 and a generally planar opposing second side 12, a first leg 16, a second leg 20, and a rotation handle 40 that extends generally perpendicularly to the first leg 16 and the second leg 20, and the body 10 defines a rotation axis 30 that is parallel to the first leg 16 and to the second leg 20, and wherein the first leg 16 and the second leg 20 each have a laterally outer edge 16*a*, 20*a* and each have a laterally inner edge 16*b*, 20*b*, and the laterally inner edge 16*b* of the first leg 16 is spaced apart from the laterally inner edge 20*b* of the second leg 20 by an elongated space 23 that is defined between the first leg 16 and the second leg 20, and an opening 24 to the elongated space 23 is defined between the first leg 16 and the second leg 20 opposite the rotation handle 40, and wherein the elongated space 23 has a length dimension 27 between the opening 23 and a terminal end 25 of the elongated space 23 proximate to the rotation handle 40, and wherein the rotation handle 40 is elongate and is offset relative to the rotation axis 30, and has a first handle 47 and an opposing second handle 41 and each of the first handle 47 and the second handle 41 have a length dimension 50, 44 and the length dimensions 50, 44 of the first handle 47 and the second handle 41 are not equal to one another.

Passing an edge portion 56 of flexible liner 55 into and through opening 24 between the first and second legs 16, 20 and into the elongated space 23 defined between the first leg 16 and the second leg 20 so that the edge portion 56 of the flexible liner 55 is in direct physical contact with the terminal end 25 of the elongated space 23.

Rotating the body 10 axially about the rotation axis 30 by means of the rotation handle 40 by twisting the body 10 in a clockwise direction, or in a counterclockwise direction, to cause a portion of the edge portion 56 of the liner 55 to wind around/gather around and about the first leg 16 and second leg 20, and the lever arm extension 35 so that the liner 55 becomes tensioned/stretched about a periphery of the receptacle 57.

Positionally retaining the body 10 that is engaged with the tensioned/stretched liner 55 to prevent the body 10 from unwinding relative to the liner 55.

Drawing an edge portion 56 of the tensioned/stretched liner 55 that is proximate the rotation handle 40 outwardly from supporting receptacle 57.

Tucking a portion 41 of the rotation handle 40 under the drawn out edge portion 56 of the tensioned/stretched liner 55 so that the tucked under portion of the rotation handle 40 is between the tensioned/stretched liner 55 edge portion 56 and the supporting receptacle 57; and releasing the edge portion 56 of the tensioned/stretched liner 55 to positionally secure the tucked under portion 41 of the rotation handle 40 between the liner 55 and the supporting receptacle 57.

Having described the structure of my fastener 9 for releasably securing a flexible liner 55 about the peripheral rim 63 of a supporting receptacle 57 its operation may be understood.

Figure 8:
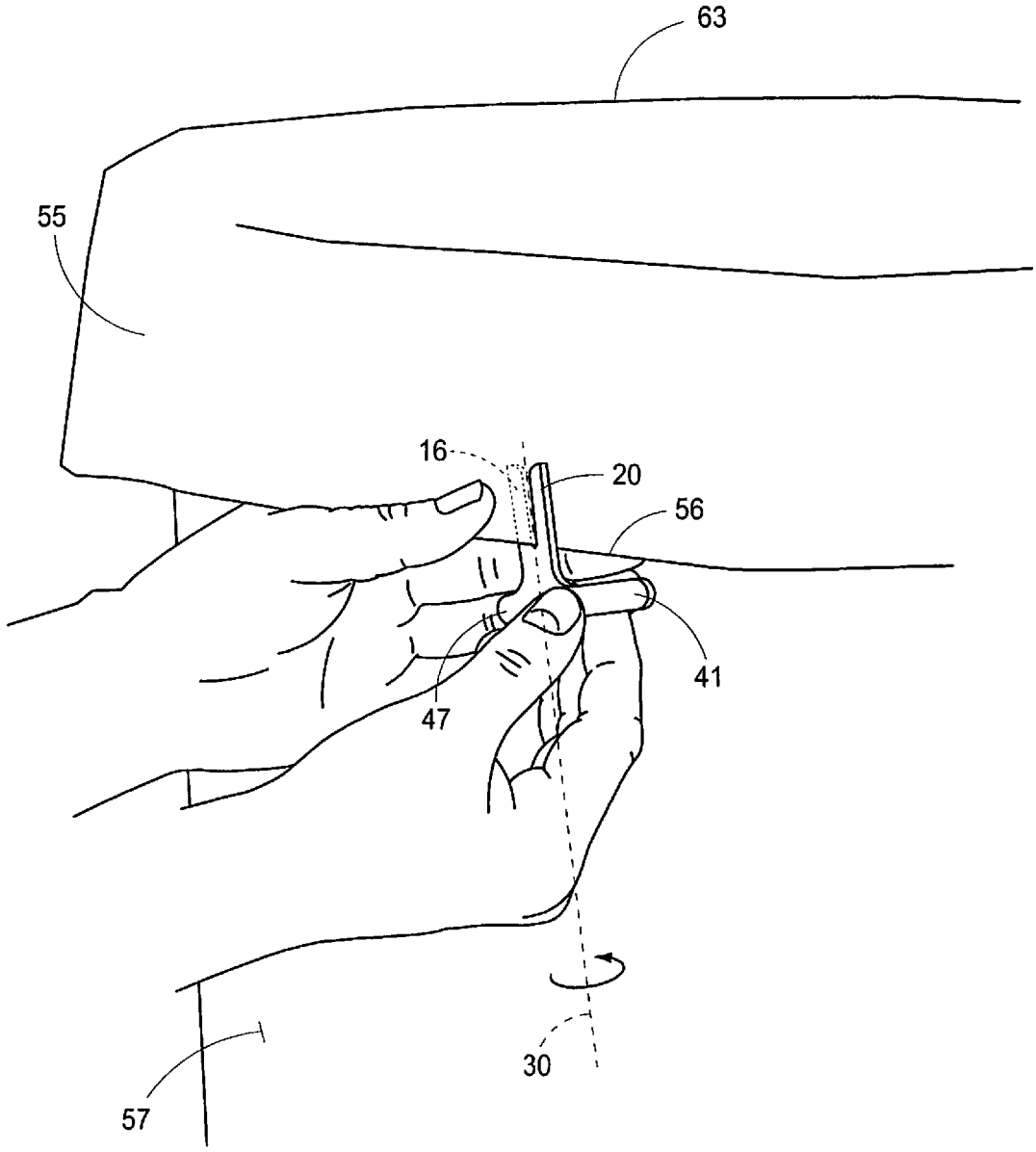
FIG. 8 is an orthographic inverted second side environmental view of my fastener in a first step of engaging with an opening edge portion of a flexible liner extending about an upper outer peripheral rim of a supporting receptacle, prior to tightening/rotation/twisting.

As shown in FIG. 8, a flexible liner 55, (in this particular instance a bag-type liner), is placed within a supporting receptacle 57 so that bottom portion (not shown) of the liner 55 is within receptacle chamber (not shown) and the upper edge portion 56 of the liner 55 is folded over and downwardly about the receptacle peripheral rim 63. The edge portion 56 of liner 55 is passed into and through opening 24 between the first and second legs 16, 20 and into the elongated space 23 defined between the first leg 16 and the second leg 20 so that the edge portion 56 is in direct physical contact with the terminal end 25 of the elongated space 23. It is preferable that the body 10 be positioned angularly relative to the edge portion 56 of the liner 55 so that the axis of rotation 30 is not perpendicular to the edge portion 56. The angular positioning of the body 10 relative to the edge portion 56 causes engagement of the fastener 9 with the liner 55 to be more positionally secure.

The body 10 is then rotated about the rotation axis 30 using the rotation handle 40 by twisting in a clockwise direction, or a counterclockwise direction. The axial rotation of the body 10, about the rotation axis 30, causes a portion of the edge portion 56 of the liner 55 extending over and about the upper peripheral rim 63 to wind around/gather around the first leg 16 and second leg 20, and the lever arm extension 35. As the liner 55 is wound about the first and second legs 16, 20, and the lever arm extension 35, the edge portion 56 of the liner 55 is tensioned/stretched about the outer circumference of the receptacle 57 spacedly below the peripheral rim 63. Because the liner 55 has inherent resiliency, the stretching of the edge portion 56, as it is wound about the first and second legs 16, 20, and lever arm extension 35 creates a torqueing force (not shown) in a direction opposite to which the body 10 has been rotated to wind the liner 55 thereabout. The rotation handle 40 and the length 44 of the second handle 41 facilitates the winding/twisting by increasing/enhancing leverage relative to the axis of rotation 30.

Figure 9:
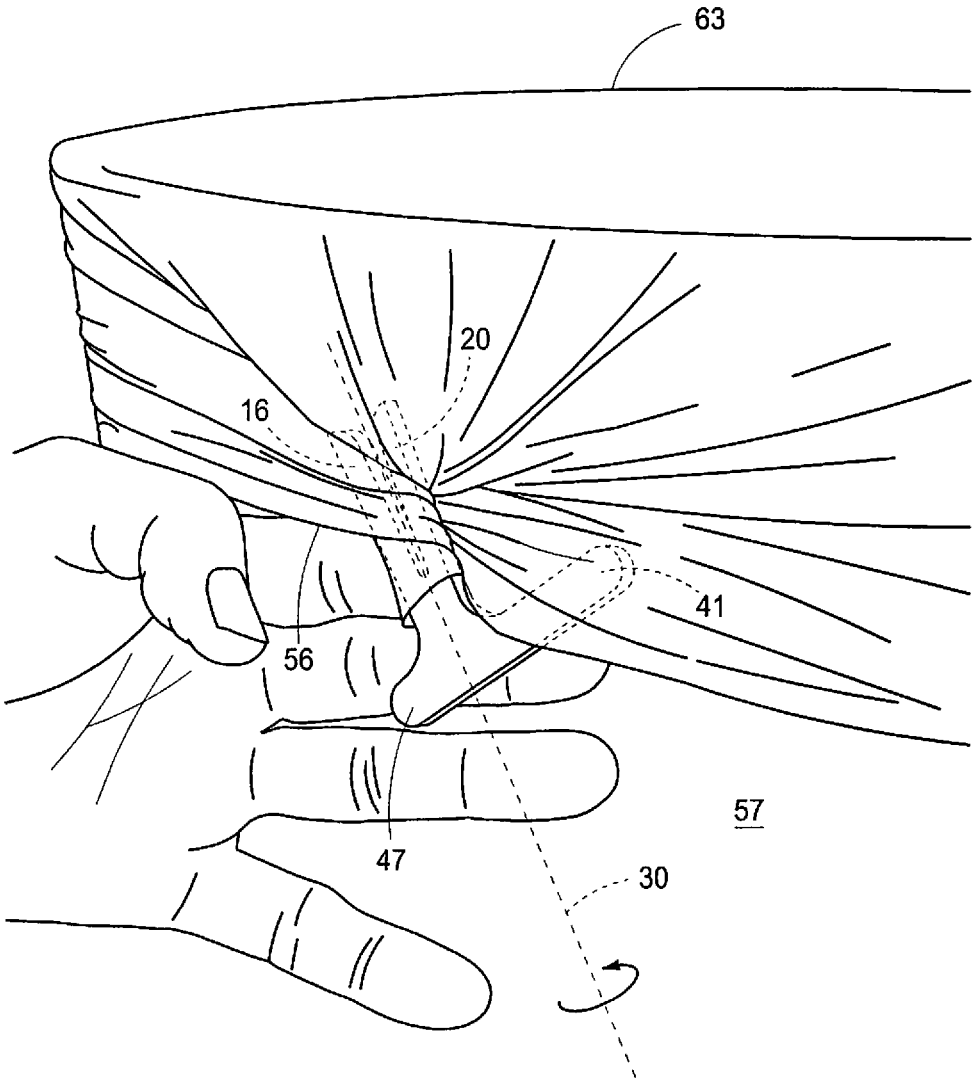
FIG. 9 is an orthographic inverted second side environmental view of my fastener in a second step showing engagement with an opening edge portion of a flexible liner extending about an upper outer peripheral rim of a supporting receptacle, and undergoing tightening/rotation/twisting.

The winding of the flexible bag type liner 55 about the first and second legs 16, 20 and lever arm extension 35 will generally cause the body 10 to bias to an even more angular orientation as shown in FIGS. 9 and 10 as the edge portion 56 of the liner 55 is stretched/tensioned.

After the edge portion 56 of the liner 55 has been stretched/tensioned to a point where it is securely engaged about a rim of the supporting receptacle 57, the fastener body 10 is restrained in place by the user (prevented from unwinding) and the user pulls the now stretched/tensioned flexible liner 55 generally radially outwardly from the receptacle 57. A portion of the length 44 of the second handle 41 is then be "tucked" under the edge portion 56 of the flexible liner, as shown in FIGS. 10 and 11. The placement of the second handle 41 under the edge portion 56, and in direct frictional contact with the supporting receptacle 57 prevents the body 10 from rotating in the opposite direction from which the flexible liner 55 is wound upon on to the body 10. The inherent elasticity of the flexible liner 55 positionally maintains the fastener 9, and responsively secures the flexible liner 55 to and about the supporting receptacle 57. (FIG. 11).

It is also possible to secure the fastener 9 to the liner 55 and receptacle 57 in a second technique, by (after wrapping/twisting a portion of the liner edge 56 about the legs 16, 20 and lever arm extension 35) pivoting the body 10 along a "Z-axis" (not shown) so that the second end portions 18, 22 of the first and second legs 16, 20 respectively, are drawn/rotated outwardly relative to the proximate surface of the receptacle 57, and simultaneously the entire rotation handle 40 and lever arm extension 35 are pushed upwardly and inwardly toward the proximate surface of the receptacle 57, and thereafter the tightened/stretched liner edge 56 is released to pull the body 10 immediately adjacent the receptacle 27. In this second technique, the fastener 9 is entirely under the liner 55 and is completely hidden from view, and the first and second legs 16, 20 are generally angulate downwardly similar to the orientation of the body 10 shown in FIG. 1. When hidden from view, the fastener 9 is less likely to be stolen.

In the event the liner 55 is used to "line" the interior, and/or an exterior of a tube (not shown) the process of tightening the fastener 9 would be performed at both ends of the tube.

To release the fastener 9 from the receptacle 57, the user simply grasps the rotation handle 40 and "un-tucks" the second handle 41 from underneath the edge portion 56. The inherent resiliency of the liner 55 will cause the fastener 9 to unwind, whereupon the fastener 9 may be removed from the edge portion 56, and the liner 55 may be removed from the receptacle 57.

I claim:

1. A fastener for releasably securing an opening edge portion of a flexible liner about a rim of a supporting receptacle that has an exterior circumferential surface, the fastener comprising:

a body having a generally planar first side, a generally planar second side, a first leg, a second leg, and a rotation handle that extends generally perpendicularly to the first leg and the second leg, and the body defines a rotation axis that extends along an elongated and tapered space defined between the first leg and the second leg;

each of the first leg and the second leg has a first end portion that is proximate to the rotation handle, each of the first leg and the second leg has a second end portion that is distal from the rotation handle, and each of the first leg and the second leg has a length dimension;

each of the first leg and the second leg has a laterally outer edge that is parallel to the rotation axis, each of the first leg and the second leg has a laterally inner edge, the laterally inner edge of the first leg is spaced apart from the laterally inner edge of the second leg by the elongated and tapered space, and an opening to the elongated and tapered space is defined between the second end portion of the first leg and the second end portion of the second leg; and each of the second end portion of the first leg and the second end portion of the second leg has an inwardly curved corner that communicates with the laterally inner edge of the respective leg, and each of the second end portion of the first leg and the second end portion of the second leg has an angular corner that communicates with the laterally outer edge of the respective leg; and the inwardly curved corner of the second end portion of the first leg and the inwardly curved corner of the second end portion of the second leg define the opening to the elongated and tapered space; and the elongated and tapered space has a length dimension extending between the opening to the elongated and tapered space and a terminal end of the elongated and tapered space that is proximate to the rotation handle; and the rotation handle is elongate and offset relative to the elongated and tapered space, the rotation handle has a first handle and a second handle opposite the first handle, each of the first handle and the second handle has a length dimension, and the length dimension of the first handle is not equal to the length dimension of the second handle.

2. The fastener of claim 1 and wherein a combined sum of the length dimension of the first handle of the rotation handle and the length dimension of the second handle of the rotation handle is greater than a combined sum of a width dimension of the first leg, a width dimension of the second leg, and a width dimension of the elongated and tapered space defined between the first leg and the second leg.

3. The fastener of claim 1 and further comprising:

a lever arm extension between the rotation handle and the first end portion of the first leg and between the rotation handle and the first end portion of the second leg; and the lever arm extension has a length dimension between the terminal end of the elongated and tapered space and the rotation handle so as to space the first leg and the second leg away from the rotation handle.

4. The fastener of claim 1 and wherein the first handle of the rotation handle has a linear top edge and a bottom edge with a height dimension therebetween; and the second handle of the rotation handle has a linear top edge and a linear bottom edge with a height dimension therebetween, the first handle has a rounded terminal end opposite the second handle, and the second handle has a rounded terminal end opposite the first handle.

5. The fastener of claim 1 and wherein the length dimension of the second handle of the rotation handle is greater than the length dimension of the first handle of the rotation handle.

6. The fastener of claim 1 and further comprising:

a lever arm extension between the rotation handle and the first end portion of the first leg and between the rotation handle and the first end portion of the second leg; and the lever arm extension has a length dimension between the terminal end of the elongated and tapered space and the rotation handle; and a combined sum of the length dimension of the first handle of the rotation handle and the length dimension of the second handle of the rotation handle is greater than a combined sum of the length dimension of the first leg, the length dimension of the lever arm extension, and a height dimension of the rotation handle.

7. The fastener of claim 1 and wherein the second handle is a lever arm that is configured to provide leverage for axial rotation of the body about the rotation axis.

8. The fastener of claim 1 and wherein the second handle of the rotation handle is configured to simultaneously frictionally engage with both the flexible liner and the exterior circumferential surface of the supporting receptacle for positionally retaining the body and preventing the body from rotating axially.

9. The fastener of claim 1 and further comprising:

a lever arm extension between the rotation handle and the first end portion of the first leg and between the rotation handle and the first end portion of the second leg; and the fastener is configured to be engaged with the flexible liner by axially rotating the body in a first direction about the rotation axis so as to simultaneously wind a portion of the opening edge portion of the flexible liner about the first leg, the second leg, and the lever arm extension; and the fastener is configured to be prevented from disengaging with the flexible liner by direct frictional contact of the body with the exterior circumferential surface of the supporting receptacle to prevent the body from rotating axially in a second direction.

10. A fastener for releasably securing an opening edge portion of a flexible liner about a rim of a supporting receptacle that has an exterior circumferential surface, the fastener comprising:

a body having a generally planar first side, a generally planar second side, a first leg, a second leg, a lever arm extension, and a rotation handle that extends generally perpendicularly to the lever arm extension, the first leg, and the second leg, and the body defines a rotation axis; and each of the first leg and the second leg has a first end portion that is interconnected with the lever arm extension, each of the first leg and the second leg has a second end portion that is distal from the lever arm extension and the rotation handle, and each of the first leg and the second leg has a length dimension; and each of the first leg and the second leg has a laterally outer edge that is parallel to the rotation axis, each of the first leg and the second leg has a laterally inner edge opposite the laterally outer edge of the respective leg, the laterally inner edge of the first leg is spaced apart from the laterally inner edge of the second leg by an elongated space that is defined between the laterally inner edge of the first leg and the laterally inner edge of the second leg, and the elongated space tapers inwardly toward the lever arm extension, opposite the second end portion of the first leg, and opposite the second end portion of the second leg; and each of the second end portion of the first leg and the second end portion of the second leg has an inwardly curved corner that communicates with the laterally inner edge of the respective leg, each of the second end portion of the first leg and the second end portion of the second leg has an angular corner that communicates with the laterally outer edge of the respective leg, and the inwardly curved corner of the second end portion of the first leg and the inwardly curved corner of the second end portion of the second leg define an opening to the elongated space; and the elongated space has a length dimension that extends between the opening to the elongated space and a terminal end of the elongated space that is proximate to the lever arm extension, and the elongated space has a width dimension at the opening to the elongated space and a width dimension at the terminal end of the elongated space that is less than the width dimension at the opening to the elongated space; and the rotation axis of the body extends through the terminal end of the elongated space and the opening to the elongated space; and the lever arm extension structurally communicates between the first end portion of the first leg and the rotation handle and between the first end portion of the second leg and the rotation handle, and the lever arm extension has a length dimension between the terminal end of the elongated space and the rotation handle to space the first leg and the second leg away from the rotation handle; and the rotation handle is elongate and offset relative to the rotation axis, the rotation handle includes a first handle that has a linear top edge and a bottom edge with a height dimension therebetween, the rotation handle includes a second handle that has a linear top edge and a linear bottom edge with a height dimension therebetween, and each of the first handle and the second handle has a length dimension, and the length dimension of the first handle and the length dimension of the second handle are not equal to one another, the rotation handle structurally communicates with the lever arm extension opposite the first leg and the second leg, and each of the first handle and the second handle has a terminal end that is rounded.

11. A method for using a fastener for releasably securing an opening edge portion of a flexible liner about a rim of a supporting receptacle that has an exterior circumferential surface, the method comprising the steps:

providing the fastener that has a body with a generally planar first side, a generally planar second side, a first leg, a second leg, and a rotation handle that extends generally perpendicularly to the first leg and the second leg, the body defines a rotation axis, each of the first leg and the second leg has a laterally outer edge that is parallel to the rotation axis, each of the first leg and the second leg has a laterally inner edge, the laterally inner edge of the first leg is spaced apart from the laterally inner edge of the second leg by an elongated space, an opening to the elongated space is defined between the laterally inner edge of the first leg and the laterally inner edge of the second leg and opposite the rotation handle, the elongated space has a length dimension between the opening to the elongated space and a terminal end of the elongated space proximate to the rotation handle, the elongated space is tapered inwardly toward the terminal end of the elongated space, the rotation axis extends though the opening to the elongated space and the terminal end of the elongated space, each of the first leg and the second leg has an inwardly curved corner that communicates with the laterally inner edge of the respective leg, each of the first leg and the second leg has an angular corner that communicates with the laterally outer edge of the respective leg, the inwardly curved corner of the first leg and the inwardly curved corner of the second leg define the opening to the elongated space, the rotation handle is elongate and offset relative to the rotation axis, the rotation handle has a first handle and a second handle, each of the first handle and the second handle has a length dimension, and the length dimension of the first handle and the length dimension of the second handle are not equal to one another;

passing an edge of the opening edge portion of the flexible liner into and through the opening to the elongated space between the first leg and the second leg and into the elongated space, so that the edge of the opening edge portion of the flexible liner is in direct physical contact with the terminal end of the elongated space;

rotating the body axially about the rotation axis by means of the rotation handle by twisting the body in a clockwise direction, or a counterclockwise direction, to cause a portion of the edge of the opening edge portion of the flexible liner to wind around and about the first leg, the second leg, and the lever arm extension, so that the flexible liner becomes tensioned or stretched about the rim of the supporting receptacle and a portion of the exterior circumferential surface of the supporting receptacle;

positionally restraining the body of the fastener that is engaged with the tensioned or stretched flexible liner to prevent the body of the fastener from unwinding;

drawing a portion of the opening edge portion of the tensioned or stretched flexible liner that is proximate to the body of the fastener outwardly from the exterior circumferential surface of the supporting receptacle;

tucking the second handle of the rotation handle under the drawn out portion of the opening edge portion of the tensioned or stretched flexible liner, so that the second handle of the rotation handle is between the opening edge portion of the tensioned or stretched flexible liner and the exterior circumferential surface of the supporting receptacle and in direct physical frictional contact with the exterior circumferential surface of the supporting receptacle; and releasing the opening edge portion of the tensioned or stretched flexible liner to positionally secure the second handle of the rotation handle of the body of the fastener between the flexible liner and the exterior circumferential surface of the supporting receptacle.

* * * * *